US008871054B2

(12) United States Patent
Sealey

(10) Patent No.: US 8,871,054 B2
(45) Date of Patent: Oct. 28, 2014

(54) PROCESS FOR PREPARING FLUFF PULP SHEET WITH CATIONIC DYE AND DEBONDER SURFACTANT

(75) Inventor: James E. Sealey, Loveland, OH (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 13/188,039

(22) Filed: Jul. 21, 2011

(65) Prior Publication Data

US 2012/0048493 A1 Mar. 1, 2012

Related U.S. Application Data

(60) Provisional application No. 61/366,619, filed on Jul. 22, 2010.

(51) Int. Cl.

| | |
|---|---|
| ***D21F 11/00*** | (2006.01) |
| ***D21H 21/28*** | (2006.01) |
| ***D21H 17/07*** | (2006.01) |
| ***D21H 17/66*** | (2006.01) |
| ***D21H 17/21*** | (2006.01) |
| ***D21H 17/06*** | (2006.01) |
| ***D21H 17/63*** | (2006.01) |
| ***D21H 21/32*** | (2006.01) |
| ***D21H 15/04*** | (2006.01) |
| ***D21H 21/24*** | (2006.01) |
| ***D04H 1/64*** | (2012.01) |
| ***D04H 1/425*** | (2012.01) |
| ***D21C 9/00*** | (2006.01) |
| ***D21H 21/22*** | (2006.01) |

(52) U.S. Cl.

CPC ..... *D04H 1/64* (2013.01); *D21H 15/04* (2013.01); *D21H 21/24* (2013.01); *D21H 21/28* (2013.01); *D04H 1/425* (2013.01); *D21C 9/001* (2013.01); *D21H 21/22* (2013.01)

USPC ..... 162/162; 162/135; 162/158; 162/179; 162/183; 162/184; 162/185; 162/70; 241/28

(58) Field of Classification Search

CPC ..... D21C 9/005; D21C 9/001; D21H 15/04; D21H 21/24; D21H 21/22; D21H 21/28; D04H 1/425; D04H 1/64

USPC ..... 162/9, 28, 158, 162–163, 135–137, 162/179, 183–185, 70, 72, 181.1; 241/21, 241/28; 8/115.51, 116.1, 188, 403, 666, 8/918

See application file for complete search history.

(56) References Cited

U.S. PATENT DOCUMENTS 3,395,708 A * 8/1968 Hervey et al. ..... 604/375
3,554,862 A 1/1971 Hervey et al.

(Continued)

FOREIGN PATENT DOCUMENTS

CN 101349030 1/2009
CN 101575820 11/2009

(Continued)

OTHER PUBLICATIONS

Smook, Gary A., Handbook of Pulp and Paper Terminology, Angus Wilde Publications, 1990, pp. 51.

(Continued)

*Primary Examiner* — Jose Fortuna
(74) *Attorney, Agent, or Firm* — Thomas W. Barnes, III

(57) ABSTRACT

A process is provided for making a fluff pulp sheet, comprising: contacting at least one cationic dye and at least one debonder surfactant with a composition comprising fluff pulp fibers, to form a fluff pulp mixture; forming a web from the fluff pulp mixture; and drying the web, to obtain the fluff pulp sheet. A fluff pulp sheet is also provided, comprising a web comprising fluff pulp fibers; at least one cationic dye; and at least one debonder surfactant. Products and uses of the fluff pulp sheet are also provided.

28 Claims, 3 Drawing Sheets

(56) References Cited

U.S. PATENT DOCUMENTS

| | | | | |
|---|---|---|---|---|
| 3,627,630 | A | 12/1971 | Gagnon | |
| 3,819,470 | A | 6/1974 | Shaw et al. | |
| 3,903,889 | A | 9/1975 | Torr | |
| 4,022,965 | A | 5/1977 | Goheen et al. | |
| 4,075,136 | A | 2/1978 | Schaper | |
| 4,081,316 | A | 3/1978 | Aberg et al. | |
| 4,089,647 | A * | 5/1978 | Mockli | 8/655 |
| 4,144,122 | A * | 3/1979 | Emanuelsson et al. | 162/158 |
| 4,166,894 | A | 9/1979 | Schaper | |
| 4,174,417 | A | 11/1979 | Rydell | |
| 4,383,834 | A * | 5/1983 | Degen et al. | 8/551 |
| 4,394,212 | A * | 7/1983 | Pociluyko | 162/162 |
| 4,425,186 | A * | 1/1984 | May et al. | 162/158 |
| 4,431,481 | A | 2/1984 | Drach | |
| 4,439,271 | A | 3/1984 | Samuelson | |
| 4,496,427 | A | 1/1985 | Davison | |
| 4,720,383 | A | 1/1988 | Drach et al. | |
| 4,777,736 | A | 10/1988 | VanOursouw et al. | |
| 4,973,382 | A | 11/1990 | Kinn et al. | |
| 4,986,882 | A * | 1/1991 | Mackey et al. | 162/109 |
| 5,049,235 | A | 9/1991 | Barcus et al. | |
| 5,061,344 | A | 10/1991 | Wedin et al. | |
| 5,068,009 | A | 11/1991 | Jokinen et al. | |
| 5,160,789 | A | 11/1992 | Barcus et al. | |
| 5,209,953 | A | 5/1993 | Grupe et al. | |
| 5,225,047 | A | 7/1993 | Graef et al. | |
| 5,231,122 | A | 7/1993 | Palumbo et al. | |
| 5,266,250 | A | 11/1993 | Kroyer | |
| 5,350,370 | A | 9/1994 | Jackson et al. | |
| 5,360,420 | A | 11/1994 | Cook et al. | |
| 5,443,899 | A | 8/1995 | Barcus et al. | |
| 5,447,603 | A | 9/1995 | Michalowski et al. | |
| 5,492,759 | A | 2/1996 | Erikkson et al. | |
| 5,496,626 | A | 3/1996 | Hamajima et al. | |
| 5,516,569 | A | 5/1996 | Veith et al. | |
| 5,531,728 | A | 7/1996 | Lash | |
| 5,601,921 | A | 2/1997 | Eriksson | |
| 5,662,773 | A | 9/1997 | Frederick | |
| 5,667,637 | A | 9/1997 | Jewell et al. | |
| 5,698,074 | A | 12/1997 | Barcus et al. | |
| 5,698,688 | A | 12/1997 | Smith et al. | |
| H1704 | H | 1/1998 | Wallajapet et al. | |
| 5,720,737 | A | 2/1998 | Hamajima et al. | |
| 5,731,080 | A | 3/1998 | Cousin et al. | |
| 5,780,616 | A | 7/1998 | Fornasari et al. | |
| 5,851,672 | A | 12/1998 | Wang et al. | |
| 5,865,822 | A | 2/1999 | Hamajima et al. | |
| 6,020,278 | A | 2/2000 | Gatenholm | |
| 6,059,924 | A | 5/2000 | Hoskins | |
| 6,074,524 | A | 6/2000 | Wu et al. | |
| 6,086,950 | A | 7/2000 | Masaki et al. | |
| H1909 | H | 11/2000 | Ahr | |
| 6,146,494 | A | 11/2000 | Seger et al. | |
| 6,153,003 | A | 11/2000 | Lee et al. | |
| 6,159,335 | A | 12/2000 | Owens et al. | |
| 6,162,329 | A | 12/2000 | Vinson et al. | |
| 6,228,217 | B1 | 5/2001 | Dickerson et al. | |
| 6,228,223 | B1 * | 5/2001 | Thebrin et al. | 162/163 |
| 6,248,879 | B1 | 6/2001 | Anderson et al. | |
| 6,296,737 | B1 | 10/2001 | Wu et al. | |
| 6,340,408 | B1 | 1/2002 | Norlander | |
| 6,361,651 | B1 | 3/2002 | Sun | |
| 6,417,425 | B1 | 7/2002 | Whitmore et al. | |
| 6,419,790 | B1 | 7/2002 | Leege et al. | |
| 6,458,343 | B1 | 10/2002 | Zeman et al. | |
| 6,471,824 | B1 | 10/2002 | Jewell | |
| 6,506,282 | B2 | 1/2003 | Hu et al. | |
| 6,533,898 | B2 | 3/2003 | Gross | |
| 6,579,414 | B2 | 6/2003 | Jewell | |
| 6,579,415 | B2 | 6/2003 | Jewell | |
| 6,582,557 | B2 | 6/2003 | Jewell | |
| 6,592,712 | B2 | 7/2003 | Koukoulas et al. | |
| 6,592,717 | B2 | 7/2003 | Jewell | |
| 6,603,054 | B2 | 8/2003 | Chen et al. | |
| 6,667,424 | B1 | 12/2003 | Hamilton et al. | |
| 6,692,603 | B1 | 2/2004 | Lindsay et al. | |
| 6,770,576 | B2 | 8/2004 | Cook et al. | |
| 6,808,790 | B2 | 10/2004 | Chen et al. | |
| 6,811,879 | B2 | 11/2004 | Dezutter et al. | |
| 6,837,970 | B2 | 1/2005 | Ko et al. | |
| 6,893,473 | B2 | 5/2005 | Neogi et al. | |
| 6,909,028 | B1 | 6/2005 | Shawver et al. | |
| 6,918,992 | B1 | 7/2005 | Strandberg et al. | |
| 6,930,221 | B1 | 8/2005 | Strandqvist | |
| 7,175,741 | B2 | 2/2007 | West et al. | |
| 7,252,868 | B2 | 8/2007 | Suda et al. | |
| 7,265,258 | B2 | 9/2007 | Hamilton et al. | |
| 7,334,347 | B2 | 2/2008 | Mann et al. | |
| 7,344,593 | B2 | 3/2008 | Luo et al. | |
| 7,407,615 | B2 | 8/2008 | Hohn | |
| 7,442,279 | B2 | 10/2008 | Hermans et al. | |
| 7,479,578 | B2 | 1/2009 | Garnier et al. | |
| 7,592,391 | B2 | 9/2009 | Calhoun et al. | |
| 8,328,988 | B2 | 12/2012 | Champion et al. | |
| 8,465,624 | B2 | 6/2013 | Sealey et al. | |
| 8,535,482 | B2 | 9/2013 | Jiang et al. | |
| 8,613,836 | B2 | 12/2013 | Sealey et al. | |
| 2002/0096276 | A1 | 7/2002 | Leithem et al. | |
| 2002/0099347 | A1 | 7/2002 | Chen et al. | |
| 2003/0034137 | A1 | 2/2003 | Neogi et al. | |
| 2003/0139716 | A1 | 7/2003 | Falk | |
| 2004/0122389 | A1 | 6/2004 | Mace et al. | |
| 2004/0123483 | A1 | 7/2004 | Vrbanac et al. | |
| 2005/0137547 | A1 | 6/2005 | Didier Garnier et al. | |
| 2005/0252629 | A1 | 11/2005 | Laleg | |
| 2006/0008621 | A1 * | 1/2006 | Gusky et al. | 428/156 |
| 2006/0118258 | A1 | 6/2006 | Chmielewski | |
| 2006/0137838 | A1 | 6/2006 | Luo et al. | |
| 2006/0137842 | A1 * | 6/2006 | Garnier et al. | 162/158 |
| 2006/0173432 | A1 | 8/2006 | Laumer et al. | |
| 2006/0184147 | A1 * | 8/2006 | Hamed | 604/367 |
| 2006/0246186 | A1 | 11/2006 | Nowak et al. | |
| 2006/0260773 | A1 | 11/2006 | Tan et al. | |
| 2007/0083018 | A1 * | 4/2007 | Liu et al. | 525/477 |
| 2007/0112319 | A1 | 5/2007 | Guidotti | |
| 2007/0218256 | A1 | 9/2007 | Tani | |
| 2007/0265469 | A1 * | 11/2007 | Cowman et al. | 562/561 |
| 2007/0277947 | A1 | 12/2007 | Nguyen | |
| 2008/0073043 | A1 | 3/2008 | Greschik et al. | |
| 2008/0082069 | A1 | 4/2008 | Qin et al. | |
| 2009/0124989 | A1 | 5/2009 | Wastlund-Karlsson et al. | |
| 2010/0311296 | A1 * | 12/2010 | Boehmer et al. | 442/71 |
| 2011/0030908 | A1 | 2/2011 | Sealey et al. | |
| 2011/0034891 | A1 | 2/2011 | Jiang et al. | |
| 2011/0108227 | A1 | 5/2011 | Sealey et al. | |
| 2012/0017808 | A1 * | 1/2012 | Sealey et al. | 106/805 |
| 2012/0048493 | A1 * | 3/2012 | Sealey | 162/179 |
| 2012/0073773 | A1 | 3/2012 | Jehn-Rendu et al. | |
| 2013/0139980 | A1 * | 6/2013 | Ban et al. | 162/74 |

FOREIGN PATENT DOCUMENTS

| | | | |
|---|---|---|---|
| CN | 101586287 | | 11/2009 |
| EA | 302 | | 4/1999 |
| EP | 0132128 | | 1/1985 |
| EP | 0225940 | | 12/1985 |
| EP | 184603 | | 6/1986 |
| EP | 399564 | | 11/1990 |
| EP | 896045 | | 2/1999 |
| EP | 896045 | A1 * | 2/1999 |
| EP | 896046 | A1 * | 2/1999 |
| EP | 1217120 | | 6/2002 |
| EP | 1548165 | | 6/2005 |
| GB | 301682 | | 12/1928 |
| GB | 868651 | | 5/1961 |
| GB | 1180801 | | 2/1970 |
| GB | 1367670 | | 9/1974 |
| GB | 1489520 | | 10/1977 |
| GB | 1550880 | | 8/1979 |
| KG | 254 | | 9/1998 |
| RU | 94044678 | | 6/1996 |
| RU | 2129486 | | 4/1999 |
| RU | 2150543 | | 6/2000 |
| RU | 21793 | | 2/2002 |

(56) References Cited

FOREIGN PATENT DOCUMENTS

| | | | |
|---|---|---|---|
| RU | 2201257 | | 3/2003 |
| RU | 2264453 | | 11/2005 |
| RU | 2277071 | | 5/2006 |
| RU | 2339518 | | 11/2008 |
| SU | 1033616 | | 8/1983 |
| SU | 1656032 | | 6/1991 |
| WO | 8902952 | | 4/1989 |
| WO | 9000213 | | 1/1990 |
| WO | 9105106 | | 4/1991 |
| WO | 1993016228 | | 8/1993 |
| WO | 9412725 | | 6/1994 |
| WO | 199415766 | | 7/1994 |
| WO | 199522655 | | 8/1995 |
| WO | WO 9534716 | A1 * | 12/1995 |
| WO | 9602697 | | 2/1996 |
| WO | 199640601 | | 12/1996 |
| WO | 9722744 | | 6/1997 |
| WO | 9819012 | | 5/1998 |
| WO | 2006060221 | | 6/2006 |
| WO | 2006119392 | | 11/2006 |
| WO | 2007027966 | | 3/2007 |
| WO | 2008058563 | | 5/2008 |
| WO | 2011017532 | | 2/2011 |
| WO | 2011017541 | | 2/2011 |
| WO | WO 2012012633 | A1 * | 1/2012 |

OTHER PUBLICATIONS

Air Floatation Drying, product sheet, Global Technologies, LLC online, 2008, retrieved from the Internet Retrieved Oct. 30, 2012, URL, http.www.globaltechllc.com-airfloat.html.

Smook, Gary A., Handbook of Pulp and Paper Terminology, Angus Wilde Publications, 1990, p. 85.the definition of fluff pulp.

Polyethyleneimine (PEI), Mini Enclyclopedia of Papermaking Wet End Chemistry, Dept. of Wood and Paper Science, NC State University, No Date, 2 pages, [online] retrieved from Internet [retrieved Jan. 8, 2014].

* cited by examiner

Figure 2

| Clariant - Cartasol Blue KRL-NA liq | | | | | | | | |
|---|---|---|---|---|---|---|---|---|
| | 395 D65/10 | | | 420 C/2 | | | | |
| Dye #/t | L* | a* | b* | L* | a* | b* | ISO Brightness | D65 Brightness |
| | | | | | | | | |
| 6.6 | 66.31 | -2.64 | -17.29 | 65.48 | 1.59 | -18.93 | 50.79 | 50.81 |
| 7.6 | 65.3 | -2.58 | -17.62 | 64.46 | 1.76 | -19.3 | 49.47 | 49.51 |
| 8.9 | 63.46 | -2.54 | -18.26 | 62.59 | 1.97 | -19.99 | 47.15 | 47.18 |
| 10.6 | 61.98 | -2.36 | -18.74 | 61.09 | 2.31 | -20.54 | 45.29 | 45.32 |
| 13.3 | 59.84 | -2.19 | -19.45 | 58.92 | 2.73 | -21.36 | 42.7 | 42.73 |
| 17.7 | 55.72 | -1.83 | -20.39 | 54.73 | 3.33 | -22.35 | 37.67 | 37.69 |
| 26.6 | 50.76 | -1.5 | -21.53 | 49.72 | 4.04 | -23.64 | 32.16 | 32.18 |
| 53.2 | 38.58 | 0.46 | -20.49 | 37.62 | 5.98 | -22.68 | 19.79 | 19.8 |
| | | | | | | | | |
| Pulp | 96.34 | -0.45 | 5.96 | 96.49 | -1.04 | 5.91 | 83.55 | 83.68 |
| | | | | | | | | |
| Coater trial | 71.55 | -3.5 | -15.36 | 70.8 | 0.2 | -16.81 | 57.92 | 57.96 |
| | | | | | | | | |

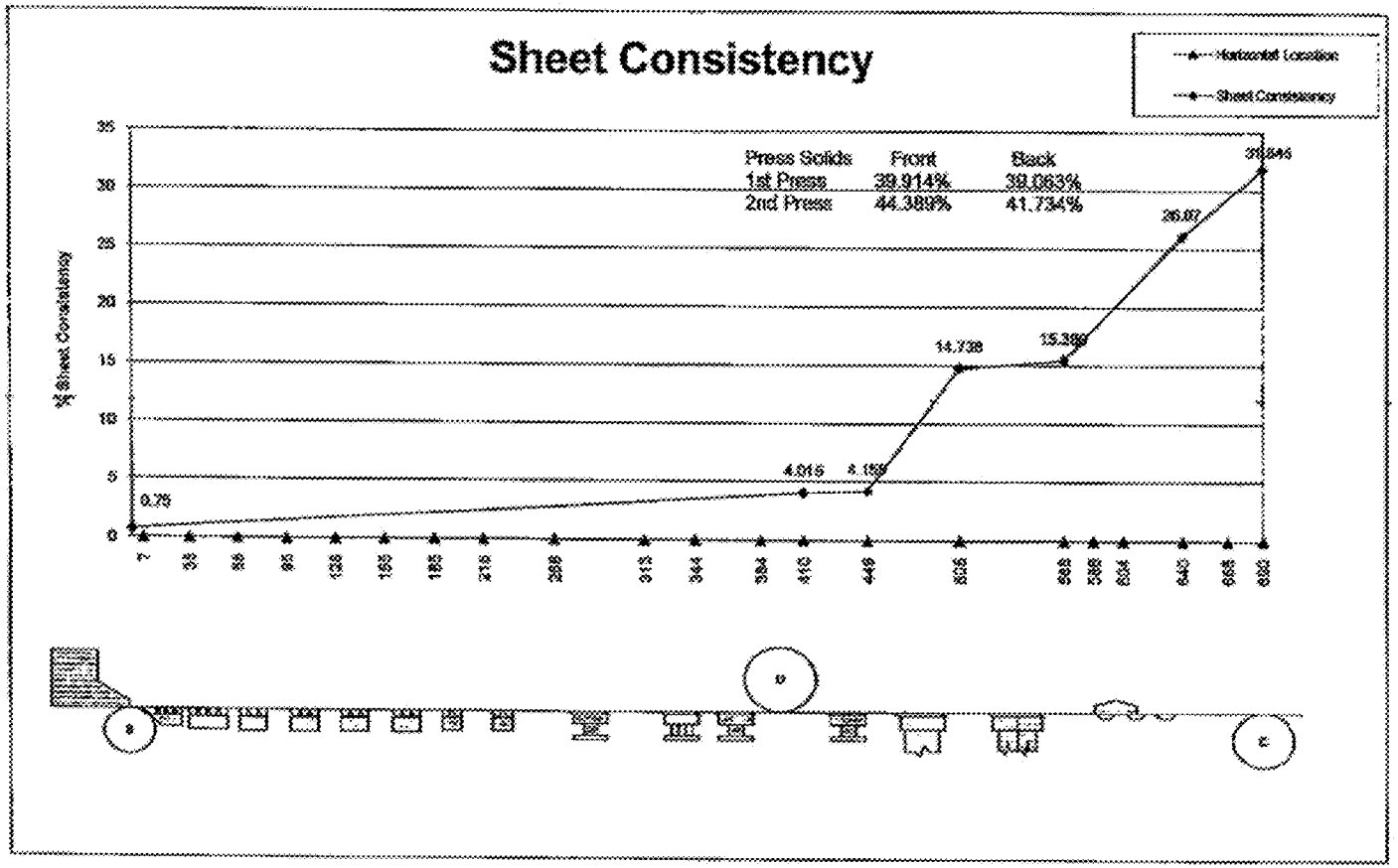
Sheet Consistency
Horizontal Location
Sheet Consistency
% Sheet Consistency
Press Solids
1st Press
2nd Press
Front
29.914%
44.389%
Back
39.085%
41.734%
35
30
25
20
15
10
5
0
0
7
20
35
50
65
80
95
110
125
140
155
170
185
200
215
230
245
260
275
290
305
320
335
350
365
380
395
410
425
440
455
470
485
500
515
530
545
560
575
590
605

PROCESS FOR PREPARING FLUFF PULP SHEET WITH CATIONIC DYE AND DEBONDER SURFACTANT

BACKGROUND

Field of the Invention

The invention relates to fluff pulp sheets, processes for making, and their use.

BRIEF DESCRIPTION OF THE FIGURES

Various embodiments are described in conjunction with the accompanying figures, in which:

FIG. 2 shows CIELAB L A B color data on blue pulp samples made according to the description herein and in accordance with known CIELAB color space parameters.

FIG. 3 shows sheet consistency of a fluff pulp sheet versus location of the sheet on a papermaking machine.

DETAILED DESCRIPTION OF THE SEVERAL EMBODIMENTS

Figure 1:
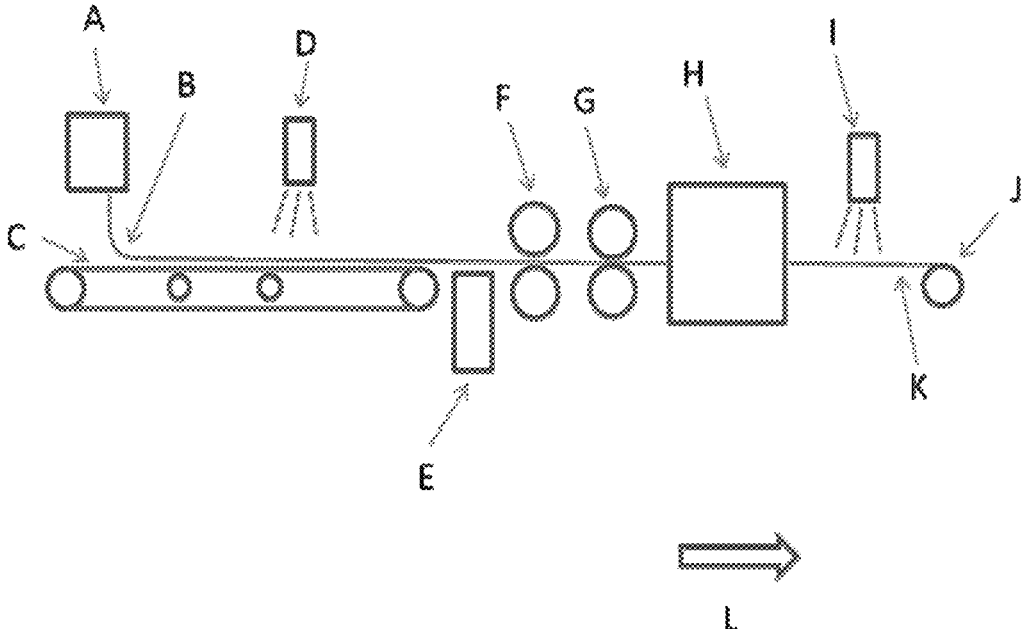
FIG. 1 shows a schematic example of one embodiment of a suitable papermaking machine, wherein A is a head box; B is a composition (e.g., fluff pulp mixture) applied to a table C from head box B; D is a formation shower; E is a suction box; F is a first press; G is a second press or transition to dryer H; I is a formation shower; J is a reel for taking up the finished fluff pulp sheet K; and L is an arrow showing the machine direction of the product as it progresses from head box A to reel J.

One embodiment relates to a process for making a fluff pulp sheet, comprising:

contacting at least one cationic dye and at least one debonder surfactant with a composition comprising fluff pulp fibers, to form a fluff pulp mixture;

forming a web from the fluff pulp mixture; and drying the web, to obtain the fluff pulp sheet.

One embodiment relates to a process for making a fluff pulp sheet, comprising:

contacting at least one debonder surfactant with a composition comprising fluff pulp fibers, to form a fluff pulp mixture;

forming a web from the fluff pulp mixture;

contacting the web with at least one cationic dye, to obtain a dyed web; and drying the dyed web, to obtain the fluff pulp sheet.

One embodiment relates to a process for making a fluff pulp sheet, comprising:

forming a web comprising fluff pulp fibers;

contacting the web with at least one cationic dye and at least one debonder surfactant, to obtain a dyed web; and drying the dyed web, to obtain the fluff pulp sheet.

One embodiment relates to a fluff pulp sheet made by any of the processes described herein.

One embodiment relates to a fluff pulp sheet, comprising:

a web comprising fluff pulp fibers;

at least one cationic dye; and at least one debonder surfactant.

One embodiment relates to an adsorbent product, paper product, personal care product, medical product, insulating product, construction product, structural material, cement, food product, veterinary product, packaging product, diaper, tampon, sanitary napkin, gauze, bandage, fire retardant, or a combination thereof, comprising the fluff pulp sheet.

In one embodiment, forming the web comprises one or more of contacting the fluff pulp mixture with a table in a papermaking machine, removing at least a portion of water from the fluff pulp mixture with a suction box under a table in a papermaking machine, heating the fluff pulp mixture, or a combination thereof.

The debonder surfactant may be suitably applied to the web. The debonder surfactant may be suitably sprayed onto the web, for example using a formation shower or spray boom over the table, coated onto the web using known coating methods in the papermaking arts, or the web may be immersed into the debonder surfactant. Combinations of application methods are possible.

In one embodiment, the debonder surfactant is sprayed onto the web.

In one embodiment, the spraying is carried out using one or more formation showers over a table in a papermaking machine.

The web may be suitably dried in a drying section. Any method for drying commonly known in the art of fluff pulp papermaking may be utilized. The drying section may include and contain a drying can, flotation dryer, cylinder drying, Condebelt drying, IR, or other drying means and mechanisms known in the art. The fluff pulp sheet may be dried so as to contain any selected amount of water.

In one embodiment, the web is dried using a flotation dryer.

In one embodiment, a second debonder surfactant may optionally be applied to the fluff pulp sheet or web as appropriate. The thus-applied second debonder surfactant may be the same or different from the debonder surfactant applied at the wet end. In one embodiment, the second debonder surfactant is applied to the fluff pulp sheet after the last drying step. In one embodiment the second debonder surfactant is applied to the fluff pulp sheet before the sheet is taken up on the reel. The second debonder surfactant may be suitably applied by spraying, for example, from a second formation shower or spray boom located at the dry end.

In one embodiment, pH of the fluff pulp mixture or web or both may be adjusted, for example, to adjust the bonding and/or the dispersion of the debonder surfactant in the web or fluff pulp mixture. The pH may be suitably raised, for example, by applying one or more known pH adjusters to the web as it moves along the table. In one embodiment, the pH adjuster may be applied using a formation shower, spray boom, or the like, or a combination thereof.

The web may be suitably dried to a moisture content of between 0 and 70%. This range includes all values and subranges therebetween, including 0, 0.1, 0.2, 0.3, 0.4, 0.5, 0.6, 0.7, 0.8, 0.9, 1, 2, 3, 4, 5, 6, 7, 8, 9, 10, 12, 14, 16, 18, 20, 25, 30, 35, 40, 45, 50, 55, 60, 65, 70% or any combination thereof or range therein. In one embodiment, the web is dried to a moisture content of ≤70%. In another embodiment, the web is dried to a moisture content of ≤50%. In another embodiment, the web is dried to a moisture content of ≤25%. In another embodiment, the web is dried to a moisture content of ≤10%. In another embodiment, the web is dried to a moisture content of ≤7%. In another embodiment, the web is dried to a moisture content of about 6.3%.

In one embodiment, the web may have a basis weight ranging from 50 to 1100 gsm. This range includes all values and subranges therein, for example 50, 75, 100, 125, 150, 175, 200, 225, 250, 275, 300, 400, 500, 600, 700, 800, 900, 1000, 1100 gsm, or any combination thereof or range therein.

In one embodiment, the solids content of the web and/or fluff pulp sheet at the point or points of applying the debonder surfactant may suitably range from 1 to 100%. This range includes all values and subranges therebetween, including 1, 2, 3, 4, 5, 6, 7, 8, 9, 10, 15, 20, 25, 30, 35, 40, 45, 50, 55, 60, 65, 70, 75, 80, 85, 90, 95, 99, 100%, or any combination thereof or any range therein. In one embodiment, the solids content of the web and/or fluff pulp sheet at the point or points of applying one or more debonder surfactant is >1%. In another embodiment, the solids content of the web and/or fluff pulp sheet at the point or points of applying one or more debonder surfactant is >25%. In another embodiment, the solids content of the web and/or fluff pulp sheet at the point or points of applying one or more debonder surfactant is >50%.

In one embodiment, the fluff pulp mixture further comprises one or more additive such as whitener, colorant, pigment, optical brightening agent, wetting agent, binder, bleaching agent, other additive, or a combination thereof. If present, the amount of additive is not particularly limited. In one embodiment, the additive may be present in amounts ranging from about 0.005 to about 50 weight percent based on the weight of the fluff pulp mixture. This range includes all values and subranges therebetween, including about 0.005, 0.006, 0.007, 0.008, 0.009, 0.01, 0.02, 0.03, 0.04, 0.05, 0.06, 0.07, 0.08, 0.09, 0.1, 0.2, 0.3, 0.4, 0.5, 0.6, 0.7, 0.8, 0.9, 1, 2, 3, 4, 5, 6, 7, 8, 9, 10, 15, 20, 25, 30, 35, 40, 45, and 50 weight percent, or any combination thereof, based on the weight of the fluff pulp mixture.

In one embodiment, the web comprises a solids content of >1% by weight. This range includes all values and subranges therein, including 100, 99, 98, 97, 96, 95, 94, 93, 92, 91, 90, 85, 80, 75, 70, 65, 60, 55, 50, 45, 40, 35, 30, 25, 20, 15, 10, 9, 8, 7, 6, 5, 4, 3, 2, >1%, or any combination thereof or range therein.

In one embodiment, the debonder surfactant is applied neat or as purchased. In another embodiment, the debonder surfactant is used in combination with one or more second debonder surfactant. In another embodiment, the debonder surfactant is applied from a solution, dispersion, emulsion, or the like. If applied in solution, dispersion, emulsion, or the like, or combination thereof. In one embodiment, if applied in solution, dispersion, emulsion, or the like, the debonder surfactant concentration may suitably range from 1 to 50% by weight solids content of debonder surfactant to the weight of solution, dispersion, emulsion, or the like. This range includes all values and subranges therebetween, including 0.5, 1, 2, 3, 4, 5, 6, 7, 8, 9, 10, 11, 12, 13, 14, 15, 16, 17, 18, 19, 20, 25, 30, 35, 40, 45, 50%, or any combination thereof or range therein.

In one embodiment, the debonder surfactant is in the form of a composition further comprising water and optionally one or more pH adjusting agent, whitener, colorant, pigment, optical brightening agent, wetting agent, binder, bleaching agent, trivalent cationic metal, alum, other additive, or a combination thereof. If present, the amount of additive is not particularly limited. In one embodiment, the additive may be present in amounts ranging from about 0.005 to about 50 weight percent based on the weight of the debonder surfactant composition. This range includes all values and subranges therebetween, including about 0.005, 0.006, 0.007, 0.008, 0.009, 0.01, 0.02, 0.03, 0.04, 0.05, 0.06, 0.07, 0.08, 0.09, 0.1, 0.2, 0.3, 0.4, 0.5, 0.6, 0.7, 0.8, 0.9, 1, 2, 3, 4, 5, 6, 7, 8, 9, 10, 15, 20, 25, 30, 35, 40, 45, and 50 weight percent, or any combination thereof, based on the weight of the debonder surfactant composition.

The cationic dye is not particularly limited, and any cationic dye suitable for paper may be used. In one embodiment, the cationic dye is a substantive dye. In one embodiment, the cationic dye is a direct dye. In one embodiment, the cationic dye is a substantive direct dye. In one embodiment, the cationic dye has a strong affinity to cellulose fibers.

Examples of cationic dyes, which are not intended to be limiting, include the Cartasol K dyes available from Clariant (Charlotte, N.C., U.S.A.) such as Cartasol Brilliant Yellow K-6G liquid, Cartasol Yellow K-4GL™ liquid, Cartasol Yellow K-GL™ liquid, Cartasol Orange K-3GL™ liquid, Cartasol Scarlet K-2GL™ liquid, Cartasol Red K-3BN™ liquid, Cartasol Blue K-5R™ liquid, Cartasol Blue K-RL™ liquid, Cartasol Turquoise K-RL™ liquid/granules, Cartasol Brown K-BL™ liquid, and the like, or any combination of two or more thereof. In one embodiment, the cationic dye is Cartasol Blue KRL-NA™ from Clariant (Charlotte, N.C.).

Debonder surfactants are known in the fluff pulp and fluff pulp fiber arts. Any debonder surfactant is suitable for use in the present application, and the selection thereof is within the skill of one knowledgeable in the fluff pulp and fluff pulp fiber arts. Some examples, which are not intended to be limiting, include linear or branched monoalkyl amine, linear or branched dialkyl amine, linear or branched tertiary alkyl amine, linear or branched quaternary alkyl amine, ethoxylated alcohol, linear or branched, saturated or unsaturated hydrocarbon surfactant, fatty acid amide, fatty acid amide quaternary ammonium salt, dialkyl dimethyl quaternary ammonium salt, dialkylimidazolinium quaternary ammonium salt, dialkyl ester quaternary ammonium salt, triethanolamine-ditallow fatty acid, fatty acid ester of ethoxylated primary amine, ethoxylated quaternary ammonium salt, dialkyl amide of fatty acid, dialkyl amide of fatty acid, cationic surfactant, non-ionic surfactant, $C_{16}$-$C_{18}$ unsaturated alkyl alcohol ethoxylate, commercially available compound having CAS Registry No. 68155-01-1, commercially available compound having CAS Registry No. 26316-40-5, commercially available F60™, commercially available Cartaflex TS LIQ™, commercially available F639™, commercially available Hercules PS9456™, commercially available Cellulose Solutions 840™, commercially available Cellulose Solutions 1009™, commercially available EKA 509H™, commercially available EKA 639™, alone, or in any combination. Other examples of debonder surfactants are disclosed in U.S. Pat. No. 4,425,186, the contents of which being hereby incorporated by reference.

Given the teachings herein, and the knowledge of one skilled in the fluff pulp papermaking arts, one can easily determine the method of applying the debonder surfactant and cationic dye to the web, and the amount, composition, temperature, residence time, and the like, to carry out the subject matter claimed herein. For example, the total amount of debonder surfactant and cationic dye in the web and/or in the finished fluff pulp sheet may be increased or decreased or otherwise controlled by controlling the various points of addition. For example, the amount of debonder surfactant and/or cationic dye applied at the wet end may be increased or decreased by respectively decreasing or increasing that amount applied at the dry end. Further one or more than one of the same or different type of debonder surfactant, cationic dye, or any combination thereof, may be applied at any point in the process.

In one embodiment, the finished fluff pulp sheet may be fiberized or shredded, in accordance with methods known in the art. For example, the fiberizing or shredding may be carried out in a hammermill.

In one embodiment, the fluff pulp sheet and/or fiberized or shredded fluff pulp sheet, or a combination thereof may be suitably incorporated into one or more of an adsorbent product, paper product, personal care product, medical product, insulating product, construction product, structural material, cement, food product, veterinary product, packaging product, diaper, tampon, sanitary napkin, gauze, bandage, fire retardant, or a combination thereof. These products and methods for their manufacture and use are well known to those of ordinary skill in the art.

Another embodiment relates to a fluff pulp sheet, made by the process described herein.

The fiberization energy, sometimes called the shred energy, of the fluff pulp sheet is suitably less than 145 kJ/kg. This range includes all values and subranges therebetween, including 1, 2, 3, 4, 5, 6, 7, 8, 9, 10, 15, 20, 25, 30, 35, 40, 45, 50, 55, 60, 65, 70, 75, 80, 85, 90, 95, 100, 105, 110, 115, 120, 125, 130, 135, 140, 145 kJ/kg, or any combination thereof or any range therein. In one embodiment, the fiberization energy of the fluff pulp sheet is less than 135 kJ/kg. In another embodiment, the fiberization energy of the fluff pulp sheet is from 120 to less than 145 kJ/kg. In another embodiment, the fiberization energy of the fluff pulp sheet is less than 120 kJ/kg. In another embodiment, the fiberization energy of the fluff pulp sheet is from 100 to 120 kJ/kg. In another embodiment, the fiberization energy of the fluff pulp sheet is less than 100 kJ/kg. In another embodiment, the fiberization energy of the fluff pulp sheet is less than 95 kJ/kg.

In one embodiment, the fluff pulp sheet has a SCAN-C 33:80 adsorption time of <4.0 s. This range includes all values and subranges therebetween, including 1, 1.1, 1.2, 1.3, 1.4, 1.5, 1.6, 1.7, 1.8, 1.9, 2, 2.0, 2.1, 2.2., 2.3, 2.4, 2.5, 2.6, 2.7, 2.8, 2.9, 3, 3.0, 3.1, 3.2, 3.3, 3.4, 3.5, 3.6, 3.7, 3.8, 3.9, <4.0 s, or any range therein.

In one embodiment, the fluff pulp sheet on screen fractionation has a % Good of >50%. This range includes all values and subranges therebetween, including 50, 55, 60, 65, 70, 75, 80, 85, 90, 95, 100%, or any range therein.

In one embodiment, the fluff pulp sheet on screen fractionation has a % Fines of ≤40%. This range includes all values and subranges therebetween, including 1, 2, 3, 4, 5, 6, 7, 8, 9, 10, 15, 20, 25, 30, 35, 40%, or any combination thereof or any range therein.

In one embodiment, the fluff pulp sheet on screen fractionation has a % Pieces of ≤30%. This range includes all values and subranges therebetween, including 1, 2, 3, 4, 5, 6, 7, 8, 9, 10, 15, 20, 25, 30%, or any combination thereof or any range therein.

In one embodiment, the fluff pulp sheet has a Mullen of ≥90 psi. This range includes all values and subranges therebetween, including 90, 95, 100, 105, 110, 115, 120, 125, 130, 135, 140, 145, 150, 155, 160, 165, 170, 175, 180, 185, 190, 195, 200, 205, 210, 215, 220, 225, 230, 235, 240, 245, 250 psi, and higher, or any range therein.

In one embodiment, the fluff pulp sheet contains the debonder surfactant in an amount of ≥1 lb solids debonder surfactant per ton of the fluff pulp fibers. This range includes all values and subranges therebetween, including 1, 1.1, 1.2, 1.3, 1.4, 1.5, 1.6, 1.7, 1.8, 1.9, 2, 2.0, 2.1, 2.2, 2.3, 2.4, 2.5, 2.6, 2.7, 2.8, 2.9, 3, 3.0, 3.1, 3.2, 3.3, 3.4, 3.5, 3.6, 3.7, 3.8, 3.9, 4, 4.0, 5, 5.0, 6, 7, 8, 9, 10, 15, 20 lb solids debonder surfactant per ton of the fluff pulp fibers, and higher, or any combination thereof or any range therein. In one embodiment, if more than one debonder surfactant is used, this range is the total amount over all the debonder surfactants present in the fluff pulp sheet.

In one embodiment, the cationic dye is present in the fluff pulp sheet in an amount of ≥1 lb per ton of fluff pulp fibers. This range includes all values and subranges therebetween, including 1, 1.1, 1.2, 1.3, 1.4, 1.5, 1.6, 1.7, 1.8, 1.9, 2, 2.0, 2.1, 2.2, 2.3, 2.4, 2.5, 2.6, 2.7, 2.8, 2.9, 3, 3.0, 3.1, 3.2, 3.3, 3.4, 3.5, 3.6, 3.7, 3.8, 3.9, 4, 4.0, 5, 5.0, 6, 7, 8, 9, 10, 15, 20, 25, 30, 35 lb cationic dye thereof per ton of the fluff pulp fibers, or any combination thereof or any range therein. In one embodiment, if more than one cationic dye this range is the total amount over all the cationic dye present in the fluff pulp sheet.

In one embodiment, the cationic dye is present in the fluff pulp sheet in an amount ≥150 ppm. This range includes all values and subranges therebetween, including 150, 155, 160, 165, 170, 175, 180, 185, 190, 195, 200, 205, 210, 215, 220, 225, 230, 235, 240, 245, 250, 300, 330, 400, 450, 500, 550, 750, and 1000 ppm, and higher, or any combination thereof or any range therein.

In one embodiment, the fluff pulp sheet has a moisture content of 25% or less. This range includes all values and subranges therebetween, including 0, 0.1, 0.2, 0.3, 0.4, 0.5, 0.6, 0.7, 0.8, 0.9, 1, 2, 3, 4, 5, 6, 7, 8, 9, 10, 12, 14, 16, 18, 20, 25%, or any combination thereof or range therein. In another embodiment, the fluff pulp sheet has a moisture content of 20% or less. In another embodiment, the fluff pulp sheet has a moisture content of 10% or less. In another embodiment, the fluff pulp sheet has a moisture content of 7% or less. In another embodiment, the fluff pulp sheet has a moisture content of about 6.3%.

In one embodiment, the fluff pulp sheet has a density of 0.5 to 0.75 g/cc. This range includes all values and subranges therebetween, including 0.5, 0.55, 0.6, 0.65, 0.7, and 0.75 g/cc, or any range therein.

In one embodiment, the fluff pulp sheet has a caliper of 40 to 70 mm. This range includes all values and subranges therebetween, including 40, 45, 50, 55, 60, 65, 70 mm, and any range therein.

In one embodiment, the fluff pulp sheet may have a basis weight ranging from 100 to 1100 gsm. This range includes all values and subranges therein, for example 100, 125, 150, 175, 200, 225, 250, 275, 300, 400, 500, 600, 700, 800, 900, 1000, 1100, or any combination thereof or range therein.

Another embodiment relates to an adsorbent product, paper product, personal care product, medical product, insulating product, construction product, structural material, cement, food product, veterinary product, packaging product, diaper, tampon, sanitary napkin, gauze, bandage, fire retardant, or a combination thereof, comprising the fluff pulp sheet and/or fiberized or shredded fluff pulp sheet, or a combination thereof.

Another embodiment relates to the use of an adsorbent product, paper product, personal care product, medical product, insulating product, construction product, structural material, cement, food product, veterinary product, packaging product, diaper, tampon, sanitary napkin, gauze, bandage, fire retardant, napkin, paper napkin, towel, paper towel, tissue, paper tissue or a combination thereof, comprising the fluff pulp sheet and/or fiberized or shredded fluff pulp sheet, or a combination thereof.

Fluff pulp and fluff pulp fibers are known in the papermaking art. Any fluff pulp or fluff pulp fiber is suitable for use in the present application, and the selection thereof is within the skill of one knowledgeable in the fluff pulp and fluff pulp fiber arts. One or more than one, or any combination thereof, of fluff pulp and/or fluff pulp fibers may be used. The fluff pulp and fluff pulp fibers may be treated or untreated, and they may optionally contain one or more than one additives, or combination thereof, which are known in the art. Given the teachings herein, the level of treatment, if desired, and the amount of additives may be readily determined by one of ordinary skill in the fluff pulp and fluff pulp fiber arts.

Similarly, the formation of a web of fluff pulp or fluff pulp fibers or from a fluff pulp mixture or furnish onto a table from a headbox in a papermaking machine is within the skill of one knowledgeable in the fluff pulp and fluff pulp fiber arts.

The type of fluff pulp or fluff pulp fiber suitable for use herein is not intended to be limiting. Fluff pulp typically includes cellulosic fiber. The type of cellulosic fiber is not critical, and any such fiber known or suitable for use in fluff pulp paper can be used. For example, the fluff pulp can made from pulp fibers derived from hardwood trees, softwood trees, or a combination of hardwood and softwood trees. The fluff pulp fibers may be prepared by one or more known or suitable digestion, refining, and/or bleaching operations such as, for example, known mechanical, thermomechanical, chemical and/or semichemical pulping and/or other well known pulping processes. The term, "hardwood pulps" as may be used herein include fibrous pulp derived from the woody substance of deciduous trees (angiosperms) such as birch, oak, beech, maple, and eucalyptus. The term, "softwood pulps" as may be used herein include fibrous pulps derived from the woody substance of coniferous trees (gymnosperms) such as varieties of fir, spruce, and pine, as for example loblolly pine, slash pine, Colorado spruce, balsam fir and Douglas fir. In some embodiments, at least a portion of the pulp fibers may be provided from non-woody herbaceous plants including, but not limited to, kenaf, hemp, jute, flax, sisal, or abaca, although legal restrictions and other considerations may make the utilization of hemp and other fiber sources impractical or impossible. Either bleached or unbleached fluff pulp fiber may be utilized. Recycled fluff pulp fibers are also suitable for use.

The fluff pulp sheet may suitably contain from 1 to 99 wt % of fluff pulp fibers based upon the total weight of the fluff pulp sheet. In one embodiment, the fluff pulp sheet may contain from 5 to 95 wt % of fluff pulp fibers based upon the total weight of the fluff pulp sheet. These ranges include any and all values and subranges therebetween, for example, 1, 5, 10, 15, 20, 25, 30, 35, 40, 45, 50, 55, 60, 65, 70, 75, 80, 85, 90, 95 and 99 wt %.

The fluff pulp sheet may optionally contain from 1 to 100 wt % fluff pulp fibers originating from softwood species based upon the total amount of fluff pulp fibers in the fluff pulp sheet. In one embodiment, the fluff pulp sheet may contain 10 to 60 wt % fluff pulp fibers originating from softwood species based upon the total amount of fluff pulp fibers in the fluff pulp sheet. These ranges include 1, 2, 5, 10, 15, 20, 25, 30, 35, 40, 45, 50, 55, 60, 65, 70, 75, 80, 85, 90, 95, and 100 wt % and any and all ranges and subranges therein, based upon the total amount of fluff pulp fibers in the fluff pulp sheet.

All or part of the softwood fibers may optionally originate from softwood species having a Canadian Standard Freeness (CSF) of from 300 to 750. In one embodiment, the fluff pulp sheet contains fluff pulp fibers from a softwood species having a CSF from 400 to 550. These ranges include any and all values and subranges therebetween, for example, 300, 310, 320, 330, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, and 750 CSF. Canadian Standard Freeness is as measured by TAPPI T-227 standard test.

The fluff pulp sheet may optionally contain from 1 to 100 wt % fluff pulp fibers originating from hardwood species based upon the total amount of fluff pulp fibers in the fluff pulp sheet. In one embodiment, the fluff pulp sheet may contain from 30 to 90 wt % fluff pulp fibers originating from hardwood species, based upon the total amount of fluff pulp fibers in the fluff pulp sheet. These ranges include 1, 2, 5, 10, 15, 20, 25, 30, 35, 40, 45, 50, 55, 60, 65, 70, 75, 80, 85, 90, 95, and 100 wt %, and any and all values and subranges therein, based upon the total amount of fluff pulp fibers in the fluff pulp sheet.

All or part of the hardwood fibers may optionally originate from hardwood species having a Canadian Standard Freeness of from 300 to 750. In one embodiment, the fluff pulp sheet may contain fibers from hardwood species having CSF values of from 400 to 550. These ranges include 300, 310, 320, 330, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, and 750 CSF, and any and all ranges and subranges therein.

The fluff pulp sheet may optionally contain less refined fluff pulp fibers, for example, less refined softwood fibers, less refined hardwood, or both. Combinations of less refined and more refined fibers are possible. In one embodiment, the fluff pulp sheet contains fibers that are at least 2% less refined than that of fluff pulp fibers used in conventional fluff pulp sheets. This range includes all values and subranges therebetween, including at least 2, 5, 10, 15, and 20%. For example, if a conventional fluff pulp sheet contains fibers, softwood and/or hardwood, having a Canadian Standard Freeness of 350, then, in one embodiment, the fluff pulp sheet may contain fibers having a CSF of 385 (i.e. refined 10% less than conventional).

When the fluff pulp sheet contains both hardwood fluff pulp fibers and softwood fluff pulp fibers, the hardwood/softwood fluff pulp fiber weight ratio may optionally range from 0.001 to 1000. In one embodiment, the hardwood/softwood ratio may range from 90/10 to 30/60. These ranges include all values and subranges therebetween, including 0.001, 0.002, 0.005, 0.01, 0.02, 0.05, 0.1, 0.2, 0.5, 1, 2, 5, 10, 15, 20, 25, 30, 35, 40, 45, 50, 55, 60, 65, 70, 75, 80, 85, 90, 95, 100, 200, 300, 400, 500, 600, 700, 800, 900, and 1000.

The softwood fibers, hardwood fibers, or both may be optionally modified by physical and/or chemical processes to obtain the fluff pulp. Examples of physical processes include, but are not limited to, electromagnetic and mechanical processes. Examples of electrical modifications include, but are not limited to, processes involving contacting the fibers with an electromagnetic energy source such as light and/or electrical current. Examples of mechanical modifications include, but are not limited to, processes involving contacting an inanimate object with the fibers. Examples of such inanimate objects include those with sharp and/or dull edges. Such processes also involve, for example, cutting, kneading, pounding, impaling, and the like, and combinations thereof.

Nonlimiting examples of chemical modifications include conventional chemical fiber processes such as crosslinking and/or precipitation of complexes thereon. Other examples of suitable modifications of fibers include those found in U.S. Pat. Nos. 6,592,717, 6,592,712, 6,582,557, 6,579,415, 6,579,414, 6,506,282, 6,471,824, 6,361,651, 6,146,494, H1,704, 5,731,080, 5,698,688, 5,698,074, 5,667,637, 5,662,773, 5,531,728, 5,443,899, 5,360,420, 5,266,250, 5,209,953, 5,160,789, 5,049,235, 4,986,882, 4,496,427, 4,431,481, 4,174,417, 4,166,894, 4,075,136, and 4,022,965, the entire contents of each of which are hereby incorporated, independently, by reference.

Some examples of fluff, which are not intended to be limiting, include those commercially available RW Supersoft™, Supersoft L™, RW Supersoft Plus™, GT Supersoft Plus™, RW Fluff LITE™, RW Fluff 110™, RW Fluff 150™ RW Fluff 160™ GP 4881™ GT Pulp™, RW SSP™, GP 4825™, alone, or in any combination.

As discussed herein, if desired, additives such as pH adjusting agent, whitener, colorant, pigment, optical brightening agent, wetting agent, binder, bleaching agent, trivalent cationic metal, alum, other additive, or a combination thereof may be utilized. Such compounds are known in the art and otherwise commercially available. Given the teachings herein, one of ordinary skill in the fluff pulp and fluff pulp papermaking arts would be able to select and use them as appropriate. If present, the amount of additive is not particularly limited. In one embodiment, the additive may be present in amounts ranging from about 0.005 to about 50 weight percent based on the weight of the fluff pulp sheet. This range includes all values and subranges therebetween, including about 0.005, 0.006, 0.007, 0.008, 0.009, 0.01, 0.02, 0.03, 0.04, 0.05, 0.06, 0.07, 0.08, 0.09, 0.1, 0.2, 0.3, 0.4, 0.5, 0.6, 0.7, 0.8, 0.9, 1, 2, 3, 4, 5, 6, 7, 8, 9, 10, 15, 20, 25, 30, 35, 40, 45, and 50 weight percent, or any combination thereof, based on the weight of the finished fluff pulp sheet.

One or more optical brightening agents may be optionally present. Typically, the optical brightening agents are fluorescent dyes or pigments that absorb ultraviolet radiation and reemit it at a higher wavelengths in the visible spectrum (blue), thereby effecting a white, bright appearance to the paper sheet when added to the stock furnish, but any optical brightening agent may be used. Examples of optical brighteners include, but are not limited to azoles, biphenyls, coumarins, furans, stilbenes, ionic brighteners, including anionic, cationic, and anionic (neutral) compounds, such as the Eccobrite™ and Eccowhite™ compounds available from Eastern Color & Chemical Co. (Providence, R.I.); naphthalimides; pyrazenes; substituted (e.g., sulfonated) stilbenes, such as the Leucophor™ range of optical brighteners available from the Clariant Corporation (Muttenz, Switzerland), and Tinopal™ from Ciba Specialty Chemicals (Basel, Switzerland); salts of such compounds including but not limited to alkali metal salts, alkaline earth metal salts, transition metal salts, organic salts and ammonium salts of such brightening agents; and combinations of one or more of the foregoing agents.

Examples of optional fillers include, but are not limited to, clay, calcium carbonate, calcium sulfate hemihydrate, and calcium sulfate dehydrate, chalk, GCC, PCC, and the like.

Examples of optional binders include, but are not limited to, polyvinyl alcohol, Amres (a Kymene type), Bayer Parez, polychloride emulsion, modified starch such as hydroxyethyl starch, starch, polyacrylamide, modified polyacrylamide, polyol, polyol carbonyl adduct, ethanedial/polyol condensate, polyamide, epichlorohydrin, glyoxal, glyoxal urea, ethanedial, aliphatic polyisocyanate, isocyanate, 1,6 hexamethylene diisocyanate, diisocyanate, polyisocyanate, polyester, polyester resin, polyacrylate, polyacrylate resin, acrylate, and methacrylate. Other optional substances include, but are not limited to silicas such as colloids and/or sols. Examples of silicas include, but are not limited to, sodium silicate and/or borosilicates.

The composition may optionally and additionally include one or more pigments. Non-limiting examples of pigments include calcium carbonate, kaolin clay, calcined clay, aluminum trihydrate, titanium dioxide, talc, plastic pigment, ground calcium carbonate, precipitated calcium carbonate, amorphous silica, modified calcium carbonate, modified calcined clay, aluminum silicate, zeolite, aluminum oxide, colloidal silica, colloidal alumina slurry, modified calcium carbonate, modified ground calcium carbonate, modified precipitated calcium carbonate, or a mixture thereof.

In one embodiment, the modified calcium carbonate is modified ground calcium carbonate, modified precipitated calcium carbonate, or a mixture thereof. Here, the term, "modified" is sometimes referred to as "structured". These types of pigments are known to those skilled in the papermaking art.

Once prepared, the fluff pulp mixture may be formed into a single or multi-ply web on a papermaking machine such as a Fourdrinier machine or any other suitable papermaking machine known in the art. The basic methodologies involved in making fluff pulp sheets on various papermaking machine configurations are well known to those of ordinary skill in the art and accordingly will not be described in detail herein. In one embodiment, the fluff pulp mixture or fluff pulp fibers may have the form of a relatively low consistency aqueous slurry of the pulp fibers optionally together with one or more additives. In one embodiment, the fluff pulp mixture or fluff pulp fibers slurry is ejected from a head box onto a table, e.g., a porous endless moving forming sheet or wire, where the liquid, e.g., water, is gradually drained through small openings in the wire, optionally with the aid of one or more suction boxes, until a mat of pulp fibers and optionally the other materials is formed on the wire. The cationic dye and debonder surfactant are applied to the web, for example, by spraying. Alternatively, the debonder surfactant is added first, either at the head box or by spraying, in either case upstream or prior to contacting the web with the cationic dye. In one embodiment, the debonder surfactant is applied by spraying it from, for example, a formation shower at any point along the table. In one embodiment, the still-wet web is transferred from the wire to a wet press where more fiber-to-fiber consolidation occurs and the moisture is further decreased. In one embodiment, the web is then passed to a dryer section to remove a portion, most of or all of the retained moisture and further consolidate the fibers in the web. After drying, the web or fluff pulp sheet may be further treated with one or more of the same or different debonder surfactant, or any combination thereof with a formation shower, spray boom, or the like. If desired, after the dried web or fluff pulp sheet exits the last drying section, additional debonder surfactant may be applied to the dried web or fluff pulp sheet.

The precise location where the respective compositions are contacted, applied, or the like is may depend on the specific equipment involved, the exact process conditions being used and the like. These are easily determined given the teachings herein combined with the knowledge of one of ordinary skill in the papermaking art.

In one embodiment, the cationic dye is contacted with the composition at a first pH in order to at least partially solubilize the cationic dye.

In one embodiment, the cationic dye is added to the stock before the web is formed and spraying on the debonder surfactant. In another embodiment, the debonder surfactant and alum are present in the stock, the web is formed, and then additional debonder surfactant is applied.

In one embodiment, the fluff pulp sheet does not contain starch.

In one embodiment, one or more than one cationic dyes are used.

In one embodiment, the cationic dye may be added to the pulp sheet after forming, i.e., after the headbox. Even if the resulting pulp sheet is not evenly colored when produced, the airlaid product has a very consistent color to the human eye.

Without wishing to be bound by theory, it is possible that the debonder surfactant "pulls" the cationic dye through the fluff pulp sheet with the result is that all of the fibers, and not just the surface fibers, are dyed. This is both unexpected and surprising because cationic dyes typically have a very high affinity for cellulosic fibers and tend not to disperse through a cellulosic fibrous sheet.

The cationic dye and debonder surfactant may be suitably applied at the size press, sprayed on a table, on a fluff machine, in the dryer, with a size press spray boom, or to a dried sheet.

In one embodiment, the cationic dye and debonder surfactant are applied at a size press.

In another embodiment, the cationic dye and debonder surfactant are sprayed onto the web on a table of a papermaking machine before the press section but after the dandy roll. In another embodiment, the cationic dye and debonder surfactant are applied after the dandy roll.

In one embodiment, the debonder surfactant is applied before the cationic dye. For example, the debonder surfactant may be applied at the headbox, or sprayed on after the head box but before the dandy, or sprayed on after the dandy. In these embodiments, the cationic dye may be applied after the debonder surfactant is applied, for example, the cationic dye may be sprayed on after the head box but before the dandy roll, or after the dandy roll. Either or both of the debonder surfactant and cationic dye may be applied once or more than once. Any combinations of applications are possible.

In one embodiment, cationic dye is present the finished fluff pulp sheet in an amount of 6 lbs/ton, and debonder surfactant is present in the finished fluff pulp sheet in an amount of 2 lbs/ton. Here, the unit "lbs/ton" is pounds of cationic dye or debonder surfactant per ton of finished fluff pulp sheet. In one embodiment, cationic dye is present the finished fluff pulp sheet in a amount of 8 lbs/ton, and debonder surfactant is present in the finished fluff pulp sheet in an amount of 2 lbs/ton.

In one embodiment, a neat mixture of 2 parts EKA Soft F60™ debonder surfactant (available from AkzoNobel) and 8 parts of Cartasol Blue KRL-NA™ (available from Clariant, Charlotte, N.C.). cationic dye are sprayed onto cellulosic fluff pulp fibers after the head box but before the dandy roll. Before spraying, the neat mixture may be diluted as follows: 0.5 gallon neat mixture diluted with 7 gallons of water. The dilution may occur in the spray boom as appropriate. The finished fluff pulp sheet contains 2 lbs/ton of debonder surfactant and 8 lbs/ton of cationic dye.

In one embodiment, the cationic dye and debonder surfactant are sprayed using a spray boom after the dandy roll, for example, at location 449, as shown in FIG. 3.

In one embodiment, the cationic dye and debonder surfactant are sprayed using a spray boom at any location after the head box but before the dandy roll, or any of locations 7 to 344, as shown in FIG. 3.

In one embodiment, no debonder surfactant is added at the wet end.

As used throughout, ranges are used as a short hand for describing each and every value that is within the range, including all subranges therein.

Optionally, the pulp, composition, sheet, fiberized sheet, and/or article may contain synthetic fibers including but not limited to bicomponent fibers commonly known in the related technical art.

All other references, as well as their cited references, cited herein are hereby incorporated by reference with respect to relative portions related to the subject matter of the present invention and all of its embodiments.

Numerous modifications and variations on the present invention are possible in light of the above teachings. It is, therefore, to be understood that within the scope of the accompanying claims, the invention may be practiced otherwise than as specifically described herein.

What is claimed is:

1. A process for making a fluff pulp sheet, comprising:

contacting at least one cationic dye and at least one debonder surfactant with a composition comprising fluff pulp fibers, the composition having a solids content of 0.75% to 25% when contacted with said debonder surfactant, to form a fluff pulp mixture;

forming a web from the fluff pulp mixture; and drying the web, to obtain the fluff pulp sheet;

wherein the debonder surfactant comprises one or more of linear or branched monoalkyl amine, linear or branched dialkyl amine, linear or branched tertiary alkyl amine, linear or branched quaternary alkyl amine, ethoxylated alcohol, linear or branched, saturated or unsaturated hydrocarbon surfactant, fatty acid amide, fatty acid amide quaternary ammonium salt, dialkyl dimethyl quaternary ammonium salt, dialkylimidazolinium quaternary ammonium salt, dialkyl ester quaternary ammonium salt, triethanolamine-ditallow fatty acid, fatty acid ester of ethoxylated primary amine, ethoxylated quaternary ammonium salt, dialkyl amide of fatty acid, cationic surfactant, non-ionic surfactant, $C_{16}$-$C_{18}$ unsaturated alkyl alcohol ethoxylate, compound having CAS Registry No. 68155-01-1, compound having CAS Registry No. 26316-40-5, or a combination thereof.

2. The process of claim 1, wherein the fluff pulp fibers are cellulosic fibers.

3. The process of claim 1, wherein the debonder surfactant is in the form of a composition further comprising water and optionally one or more pH adjusting agent, whitener, colorant, pigment, optical brightening agent, wetting agent, binder, bleaching agent, trivalent cationic metal, alum, other additive, or a combination thereof.

4. The process of claim 1, wherein forming the web comprises one or more of contacting the fluff pulp mixture with a table in a papermaking machine, removing at least a portion of water from the fluff pulp mixture with a suction box under a table in a papermaking machine, heating the fluff pulp mixture, or a combination thereof.

5. The process of claim 1, wherein the debonder surfactant is contacted in an amount of ≥1 to 20 lb per ton of the fluff pulp fibers.

6. The process of claim 1, wherein the cationic dye is contacted in an amount of ≥1 to 35 lb per ton of fluff pulp fibers.

7. A process for fiberizing or shredding a fluff pulp sheet, comprising:

contacting at least one cationic dye and at least one debonder surfactant with a composition comprising fluff pulp fibers, the composition having a solids content of 0.75% to 25% when contacted with said debonder surfactant, to form a fluff pulp mixture;

forming a web from the fluff pulp mixture;

drying the web, to obtain a fluff pulp sheet; and fiberizing or shredding the fluff pulp sheet;

wherein the debonder surfactant comprises one or more of linear or branched monoalkyl amine, linear or branched dialkyl amine, linear or branched tertiary alkyl amine, linear or branched quaternary alkyl amine, ethoxylated alcohol, linear or branched, saturated or unsaturated hydrocarbon surfactant, fatty acid amide, fatty acid amide quaternary ammonium salt, dialkyl dimethyl quaternary ammonium salt, dialkylimidazolinium quaternary ammonium salt, dialkyl ester quaternary ammonium salt, triethanolamine-ditallow fatty acid, fatty acid ester of ethoxylated primary amine, ethoxylated quaternary ammonium salt, dialkyl amide of fatty acid, cationic surfactant, non-ionic surfactant, $C_{16}$-$C_{18}$ unsaturated alkyl alcohol ethoxylate, compound having CAS Registry No. 68155-01-1, compound having CAS Registry No. 26316-40-5, or a combination thereof.

8. A process for making a fluff pulp sheet, comprising:

contacting at least one debonder surfactant with a composition comprising fluff pulp fibers, the composition having a solids content of 0.75% to 25% when contacted with said debonder surfactant, to form a fluff pulp mixture;

forming a web from the fluff pulp mixture;

contacting the web with at least one cationic dye, to obtain a dyed web; and drying the dyed web, to obtain the fluff pulp sheet;

wherein the debonder surfactant comprises one or more of linear or branched monoalkyl amine, linear or branched dialkyl amine, linear or branched tertiary alkyl amine, linear or branched quaternary alkyl amine, ethoxylated alcohol, linear or branched, saturated or unsaturated hydrocarbon surfactant, fatty acid amide, fatty acid amide quaternary ammonium salt, dialkyl dimethyl quaternary ammonium salt, dialkylimidazolinium quaternary ammonium salt, dialkyl ester quaternary ammonium salt, triethanolamine-ditallow fatty acid, fatty acid ester of ethoxylated primary amine, ethoxylated quaternary ammonium salt, dialkyl amide of fatty acid, cationic surfactant, non-ionic surfactant, $C_{16}$-$C_{18}$ unsaturated alkyl alcohol ethoxylate, compound having CAS Registry No. 68155-01-1, compound having CAS Registry No. 26316-40-5, or a combination thereof.

9. The process of claim 8, wherein contacting the web with the cationic dye comprises spraying the cationic dye onto the web, coating the cationic dye onto the web, immersing the web in the cationic dye, or a combination thereof.

10. The process of claim 8, wherein contacting the web with the cationic dye comprises spraying the cationic dye onto the web.

11. The process of claim 8, wherein the fluff pulp fibers are cellulosic fibers.

12. The process of claim 8, wherein forming the web comprises one or more of contacting the fluff pulp mixture with a table in a papermaking machine, removing at least a portion of water from the fluff pulp mixture with a suction box under a table in a papermaking machine, heating the fluff pulp mixture, or a combination thereof.

13. The process of claim 8, wherein the debonder surfactant is in the form of a composition further comprising water and optionally one or more pH adjusting agent, whitener, colorant, pigment, optical brightening agent, wetting agent, binder, bleaching agent, trivalent cationic metal, alum, other additive, or a combination thereof.

14. The process of claim 8, wherein forming the web comprises one or more of contacting the fluff pulp mixture with a table in a papermaking machine, removing at least a portion of water from the fluff pulp mixture with a suction box under a table in a papermaking machine, heating the fluff pulp mixture, or a combination thereof.

15. The process of claim 8, wherein the debonder surfactant is contacted in an amount of ≥1 to 20 lb per ton of the fluff pulp fibers.

16. The process of claim 8, wherein the cationic dye is contacted in an amount of ≥1 to 35 lb per ton of fluff pulp fibers.

17. A process for fiberizing or shredding a fluff pulp sheet, comprising:

contacting at least one debonder surfactant with a composition comprising fluff pulp fibers, the composition having a solids content of 0.75% to 25% when contacted with said debonder surfactant, to form a fluff pulp mixture;

forming a web from the fluff pulp mixture;

contacting the web with at least one cationic dye, to obtain a dyed web;

drying the dyed web, to obtain a fluff pulp sheet; and fiberizing or shredding the fluff pulp sheet;

wherein the debonder surfactant comprises one or more of linear or branched monoalkyl amine, linear or branched dialkyl amine, linear or branched tertiary alkyl amine, linear or branched quaternary alkyl amine, ethoxylated alcohol, linear or branched, saturated or unsaturated hydrocarbon surfactant, fatty acid amide, fatty acid amide quaternary ammonium salt, dialkyl dimethyl quaternary ammonium salt, dialkylimidazolinium quaternary ammonium salt, dialkyl ester quaternary ammonium salt, triethanolamine-ditallow fatty acid, fatty acid ester of ethoxylated primary amine, ethoxylated quaternary ammonium salt, dialkyl amide of fatty acid, cationic surfactant, non-ionic surfactant, $C_{16}$-$C_{18}$ unsaturated alkyl alcohol ethoxylate, compound having CAS Registry No. 68155-01-1, compound having CAS Registry No. 26316-40-5, or a combination thereof.

18. A process for making a fluff pulp sheet, comprising:

forming a web comprising fluff pulp fibers;

contacting the web with at least one cationic dye and at least one debonder surfactant, the web having a solids content of 0.75% to 25% when contacted with said debonder surfactant, to obtain a dyed web; and drying the dyed web, to obtain the fluff pulp sheet;

wherein the debonder surfactant comprises one or more of linear or branched monoalkyl amine, linear or branched dialkyl amine, linear or branched tertiary alkyl amine, linear or branched quaternary alkyl amine, ethoxylated alcohol, linear or branched, saturated or unsaturated hydrocarbon surfactant, fatty acid amide, fatty acid amide quaternary ammonium salt, dialkyl dimethyl quaternary ammonium salt, dialkylimidazolinium quaternary ammonium salt, dialkyl ester quaternary ammonium salt, triethanolamine-ditallow fatty acid, fatty acid ester of ethoxylated primary amine, ethoxylated quaternary ammonium salt, dialkyl amide of fatty acid, cationic surfactant, non-ionic surfactant, $C_{16}$-$C_{18}$ unsaturated alkyl alcohol ethoxylate, compound having CAS Registry No. 68155-01-1, compound having CAS Registry No. 26316-40-5, or a combination thereof.

19. The process of claim 18, wherein contacting the web with the cationic dye comprises spraying a composition comprising the cationic dye and the debonder surfactant onto the web, coating a composition comprising the cationic dye and the debonder surfactant onto the web, immersing the web in a composition comprising the cationic dye and the debonder surfactant, or a combination thereof.

20. The process of claim 18, wherein the contacting comprises contacting the web with a composition comprising the cationic dye and the debonder surfactant.

21. The process of claim 18, wherein the contacting comprises contacting the web with the debonder surfactant prior to contacting the web with the cationic dye.

22. The process of claim 18, wherein the contacting comprises spraying the web with the debonder surfactant.

23. The process of claim 18, wherein the contacting comprises spraying the web with the cationic dye.

24. The process of claim 18, wherein the fluff pulp fibers are cellulosic fibers.

25. The process of claim 18, wherein forming the web comprises one or more of contacting the fluff pulp fibers with a table in a papermaking machine, removing at least a portion of water from the fluff pulp fibers with a suction box under a table in a papermaking machine, heating the fluff pulp fibers, or a combination thereof.

26. The process of claim 18, wherein the debonder surfactant is in the form of a composition further comprising water and optionally one or more pH adjusting agent, whitener, colorant, pigment, optical brightening agent, wetting agent, binder, bleaching agent, trivalent cationic metal, alum, other additive, or a combination thereof.

27. The process of claim 18, wherein forming the web comprises one or more of contacting the fluff pulp mixture with a table in a papermaking machine, removing at least a portion of water from the fluff pulp mixture with a suction box under a table in a papermaking machine, heating the fluff pulp mixture, or a combination thereof.

28. A process for fiberizing or shredding a fluff pulp sheet, comprising:

forming a web comprising fluff pulp fibers;

contacting the web with at least one cationic dye and at least one debonder surfactant, the web having a solids content of 0.75% to 25% when contacted with said debonder surfactant, to obtain a dyed web;

drying the dyed web, to obtain a fluff pulp sheet; and fiberizing or shredding the fluff pulp sheet;

wherein the debonder surfactant comprises one or more of linear or branched monoalkyl amine, linear or branched dialkyl amine, linear or branched tertiary alkyl amine, linear or branched quaternary alkyl amine, ethoxylated alcohol, linear or branched, saturated or unsaturated hydrocarbon surfactant, fatty acid amide, fatty acid amide quaternary ammonium salt, dialkyl dimethyl quaternary ammonium salt, dialkylimidazolinium quaternary ammonium salt, dialkyl ester quaternary ammonium salt, triethanolamine-ditallow fatty acid, fatty acid ester of ethoxylated primary amine, ethoxylated quaternary ammonium salt, dialkyl amide of fatty acid, cationic surfactant, non-ionic surfactant, $C_{16}$-$C_{18}$ unsaturated alkyl alcohol ethoxylate, compound having CAS Registry No. 68155-01-1, compound having CAS Registry No. 26316-40-5, or a combination thereof.

* * * * *